US006626766B1

(12) United States Patent
Hsia

(10) Patent No.: US 6,626,766 B1
(45) Date of Patent: Sep. 30, 2003

(54) SWING DEVICE WITH A DRIVING UNIT

(76) Inventor: Ben M. Hsia, 19401 Business Center Dr., Northridge, CA (US) 91324

( * ) Notice: Subject to any disclaimer, the term of this patent is extended or adjusted under 35 U.S.C. 154(b) by 0 days.

(21) Appl. No.: 10/291,529

(22) Filed: Nov. 12, 2002

(51) Int. Cl.[7] ..... A63G 9/16
(52) U.S. Cl. ..... 472/119; 5/108
(58) Field of Search ..... 472/118, 119, 472/120, 121, 122, 123, 124, 125; 297/273; 5/108, 109

(56) References Cited

U.S. PATENT DOCUMENTS 5,378,196 A * 1/1995 Pinch et al. ..... 472/119
5,846,136 A * 12/1998 Wu ..... 472/119
6,022,277 A * 2/2000 Jankowski ..... 472/119
6,544,128 B1 * 4/2003 Yang ..... 472/119

* cited by examiner

*Primary Examiner*—Kien T. Nguyen
(74) *Attorney, Agent, or Firm*—Morgan, Lewis & Bockius LLP

(57) ABSTRACT

A swing device includes a swingable member secured to an axle and having two opposing side portions and a pair of opposing abutting studs projecting respectively from the opposing side portions in an axial direction relative to the axle. A driving element is mounted rotatably on the axle, and has a pushing part with two pushing arms extending oppositely in a transverse direction relative to the axle. The pushing arms are disposed above and in sliding contact with the abutting studs of the swingable member in such a manner that swinging of the driving element about a rotating axis results in alternate pushing of the abutting studs by the pushing arms.

2 Claims, 7 Drawing Sheets

SWING DEVICE WITH A DRIVING UNIT

BACKGROUND OF THE INVENTION

1. Field of the Invention

The present invention relates to a swing device, more particularly to a swing device with a driving unit for swinging a seat unit.

2. Description of the Related Art

Conventional automatic lawn swings for small children normally include a support frame, a seat unit pivoted to the support frame so as to be swingable relative to the support frame, and a driving unit for swinging the seat unit. The driving unit uses an urging member that accumulates an amount of potential energy upon twisting in order to drive the seat unit via a mechanical linkage mechanism when released. The conventional lawn swing is disadvantageous in that it requires frequent twisting of the urging member, which is inconvenient and laborious.

SUMMARY OF THE INVENTION

The object of the present invention is to provide a swing device with a driving unit which can eliminate the aforesaid disadvantages of the prior art swing device in use.

Accordingly, a swing device of the present invention includes: a supporting frame; a seat unit having a seat member and a pair of opposing swing arms that are connected to the seat member and that are pivoted to the supporting frame so as to permit swinging of the seat member relative to the supporting frame; and a driving unit mounted on the supporting frame, and including a housing secured to the supporting frame, an axle defining a rotating axis, disposed rotatably in and extending out of the housing, and coaxially secured to one of the swing arms, and a swingable member disposed in the housing, coaxially secured to the axle, and swingable relative to the rotating axis so as to permit synchronous swinging of the seat unit through the axle. The swingable member has two opposing side portions and a pair of opposing abutting studs projecting respectively from the opposing side portions in an axial direction relative to the axle. The driving unit further includes a driving element that is disposed in the housing, that is mounted rotatably on the axle and that has a pushing part with two pushing arms extending oppositely in a first transverse direction relative to the axle. The pushing arms are disposed above and in sliding contact with the abutting studs of the swingable member, respectively, in such a manner that swinging of the driving element about the rotating axis results in alternate pushing of said abutting studs by the pushing arms, which, in turn, results in a synchronous swinging movement of the swingable member and rotation of the axle about the rotating axis, thereby permitting swinging of the swing arms and the seat member relative to the supporting frame.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
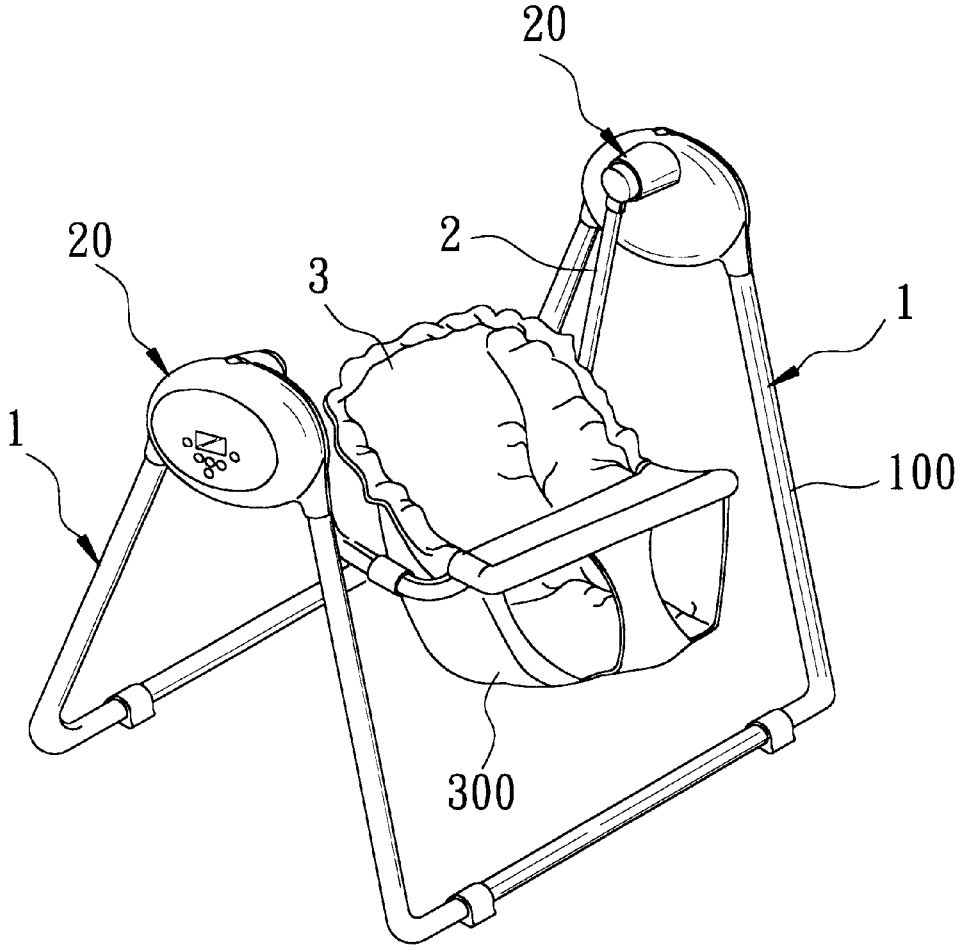
FIG. 1 is a perspective view of the preferred embodiment of a swing device according to the present invention.
Figure 2:
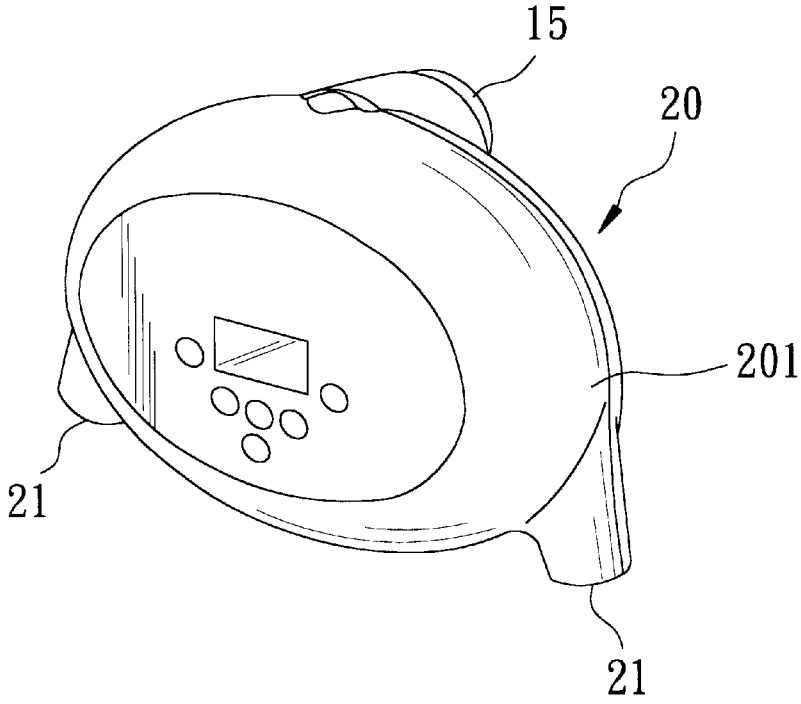
FIG. 2 is an enlarged, perspective view of a driving unit employed in the preferred embodiment shown in FIG. 1.
Figure 3:
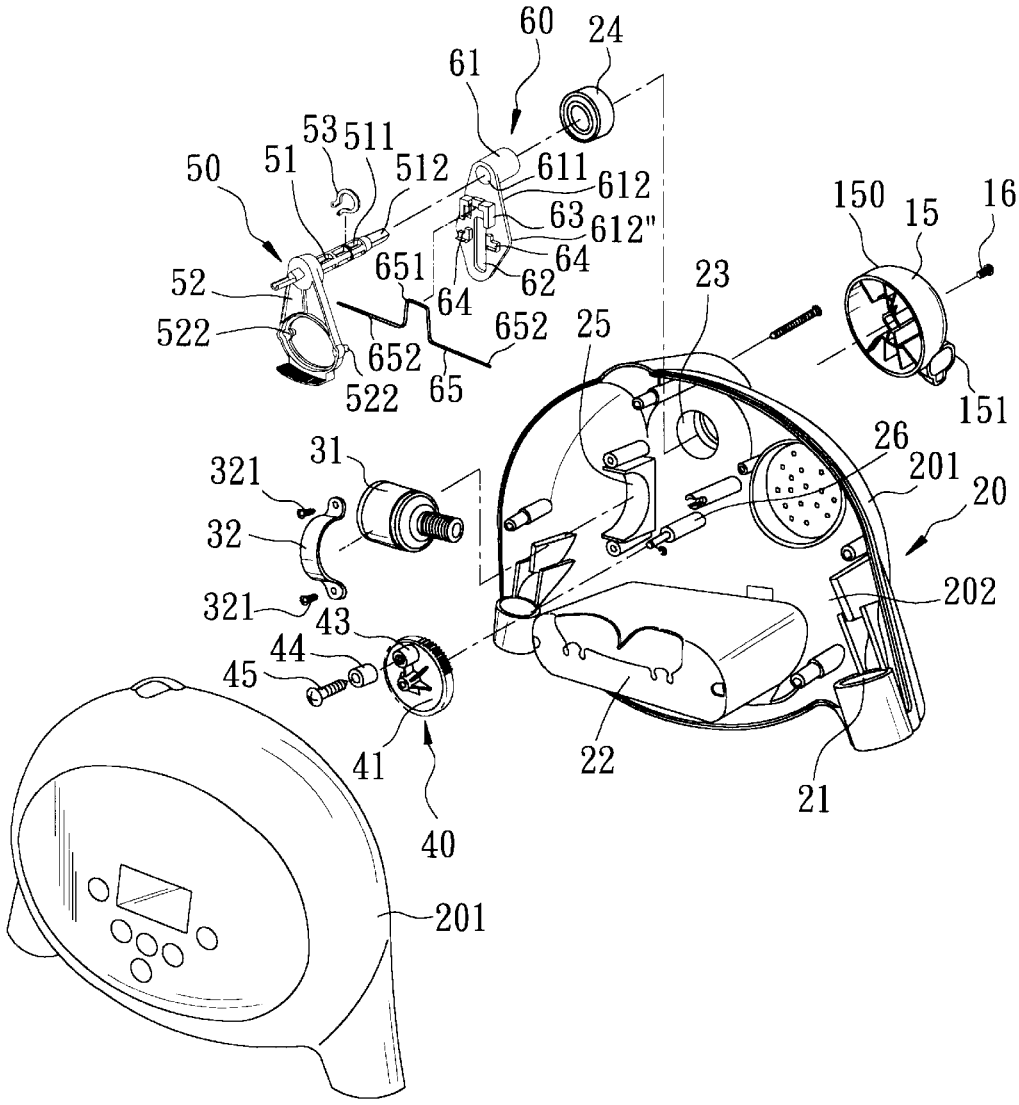
FIG. 3 is an exploded perspective view of the driving unit of FIG. 2.
Figure 4:
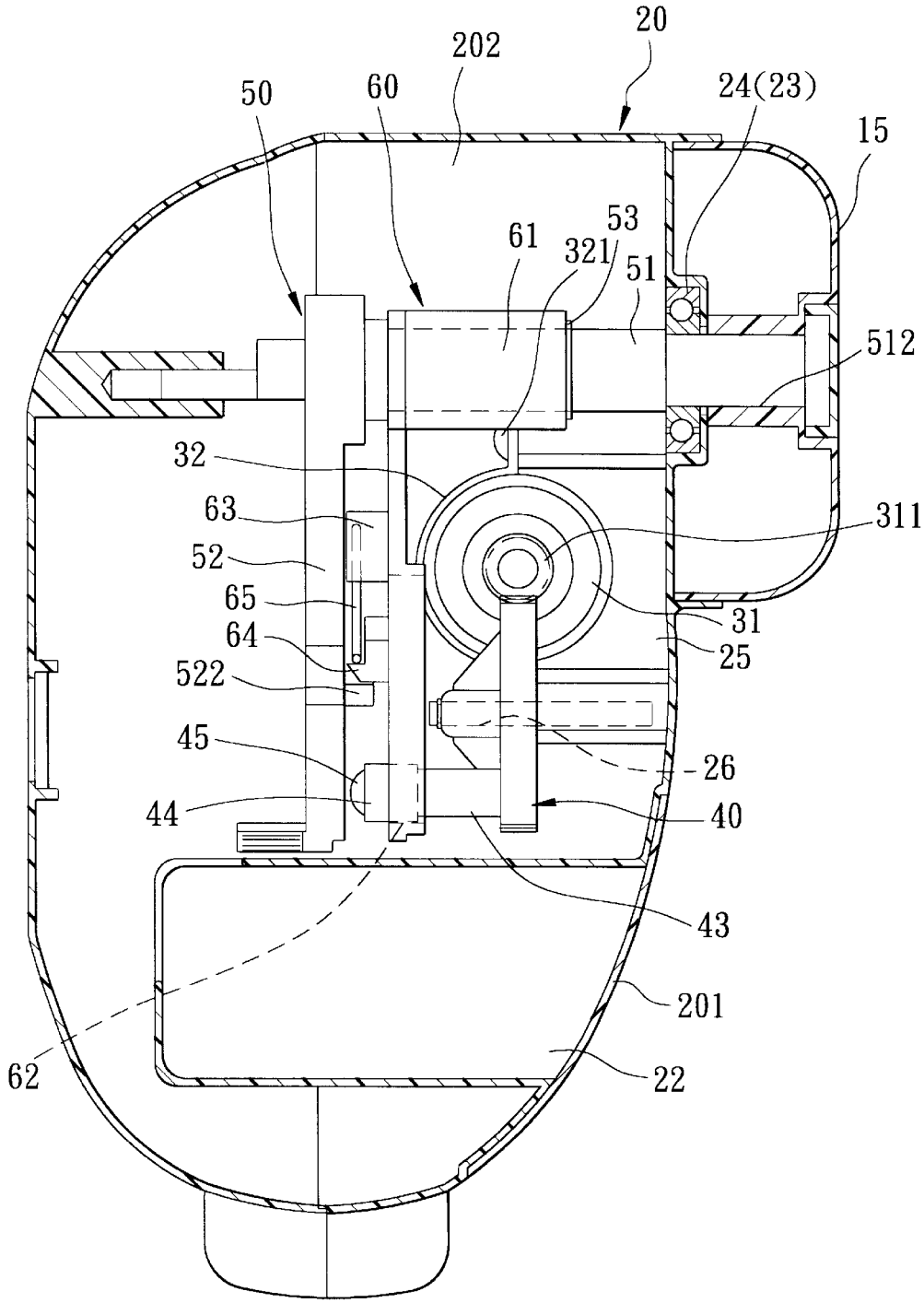
FIG. 4 is a sectional side view of the driving unit of FIG. 2.

Referring to FIGS. 1 to 4, the preferred embodiment of a swing device according to the present invention is shown to include a supporting frame 1, a seat unit 3, and two driving units 60.

As illustrated, the seat unit 3 includes a seat member 300 and a pair of opposing swing arms 2 that are connected to the seat member 300 and that are pivoted to the supporting frame 1 so as to permit swinging of the seat member 300 relative to the supporting frame 1.

Each of the driving units 60 includes a protective housing 20, an axle 51, a swingable member 50, and a driving element 61. The housing 20 is secured to one of two upright tubular portions 100 of the supporting frame 1. The axle 51 is rotatably disposed in the housing 20 by means of bearing units 24+23, and extends out of the housing 20 to securely connect with a respective one of the swing arms 2. The swingable member 50 is disposed in the housing 20, and is coaxially secured to the axle 51, thereby permitting synchronous swinging of the seat unit 3 and the swing arms 2 through the axles 51 of the driving units 60.

The housing 20 of each of the driving units 60 includes first and second halves 201 that complement each other and that confine a mounting space 202 therebetween. A battery chamber 22 is formed in the mounting space 202 for receiving a set of batteries (not shown) . The second half 201 has two lower tubular portions 21 for receiving upper ends of two tubular upright portions 100 of the supporting frame 1. The axle 51 of each of the driving units 60 has a non-circular end portion 512 extending out of the respective housing 20 to securely connect with a respective one of pivot members 15 via a screw 16. Each of the pivot members 15 has a bowl-shaped part 150 for coupling with the end portion 512 of the respective axle 51, and a tubular connecting part 151 extending from the bowl-shaped part 150 for receiving a respective one of the swing arms 2.

The swingable member 50 of each of the driving units 60 has two opposing side portions 52 and a pair of opposing abutting studs 522 projecting respectively from the opposing side portions 52 in an axial direction relative to the respective axle 51.

Figure 5:
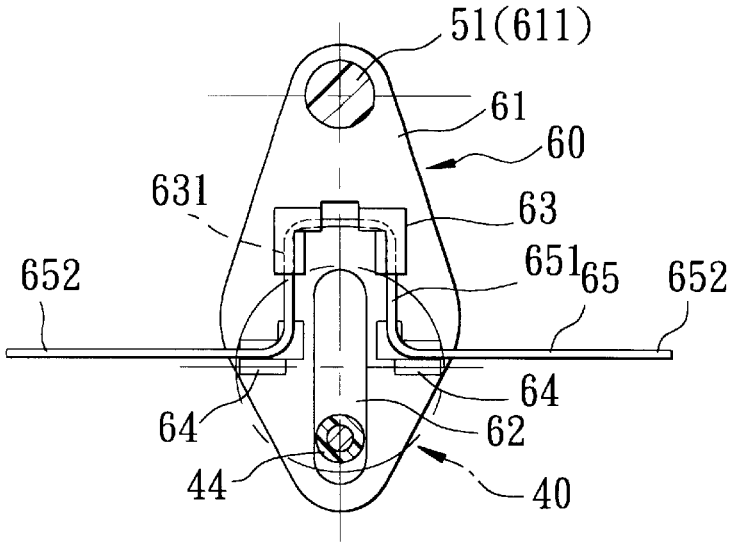
FIG. 5 is a schematic side view of a driving element employed in the driving unit of FIG. 2.
Figure 6:
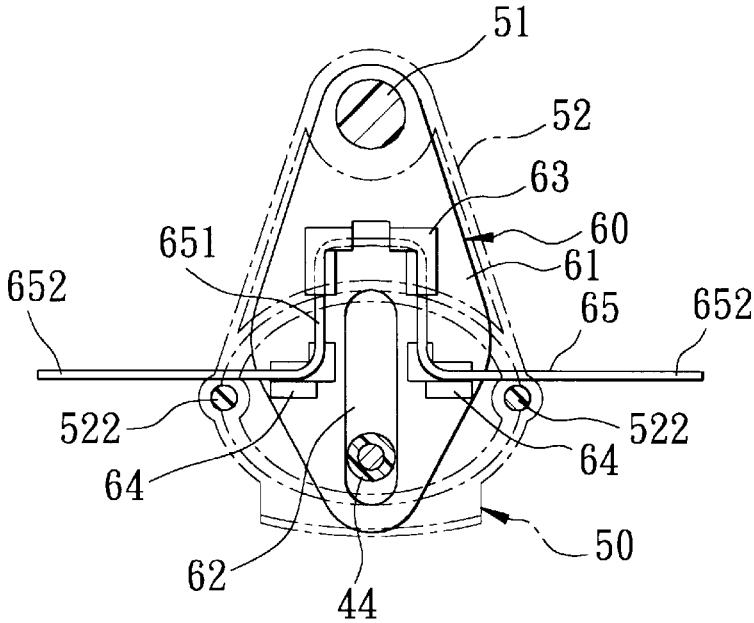
FIG. 6 is a schematic side view of the driving element and a swingable member employed in the driving unit of FIG. 2.
Figure 7:
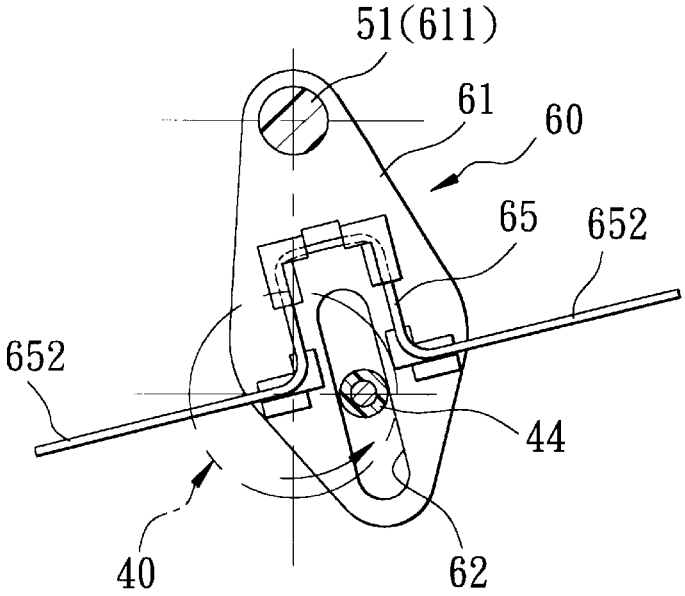
FIG. 7 illustrates how the driving element is moved to a rightward position due to eccentric rotation of a pushing rod.

Each of the driving elements 61 of the driving units 60 is disposed in the respective housing 20, is mounted rotatably on the respective axle 51 adjacent to the respective swingable member 50, and includes a pushing part 65 with two pushing arms 652 extending oppositely in a first transverse direction relative to the axle 51. The pushing arms 652 of the pushing part 65 are disposed above and in sliding contact with the abutting studs 522 of the swingable member 50, respectively, (see FIGS. 5 and 6) in such a manner that swinging of the driving element 61 about the rotating axis of the axle 51 results in alternate pushing of the abutting studs 522 by the pushing arms 652, which, in turn, results in a synchronous swinging movement of the swingable member 50 and rotation of the axle 51 about the rotating axis (see FIGS. 7 and 8), thereby permitting swinging of the swing arms 2 and the seat member 300 relative to the supporting frame 1.

In this preferred embodiment, the driving element 61 of each of the driving units 60 includes a tubular sleeve 611 sleeved rotatably on the axle 51, and a mounting plate 612 that extends downwardly from the tubular sleeve 611 and that has two opposing side portions 612" and an elongated rod-receiving slot 62 disposed between the opposing side portions 612". The rod-receiving slot 62 extends in a second transverse direction relative to the first transverse direction and the axle 51. Preferably, a C-shaped clip 53 is fitted within an annular groove 511 in the axle 51 to prevent axial displacement of the tubular sleeve 611 of the driving element 61 on the respective axle 51.

The pushing part 65, which is preferably made from a substantially stiff material, further has an inverted U-shaped rod portion 651 mounted securely on an upper retention seat 63 of the mounting plate 612 between the side portions 612" of the mounting plate 612. The pushing arms 652 are held securely by two lower retention seats 64 which are disposed on the mounting plate 612 at two sides of the rod-receiving slot 62 and below the upper retention seat 63 such that the pushing arms 652 project oppositely from the inverted U-shaped rod portion 651 in the first transverse direction.

Figure 8:
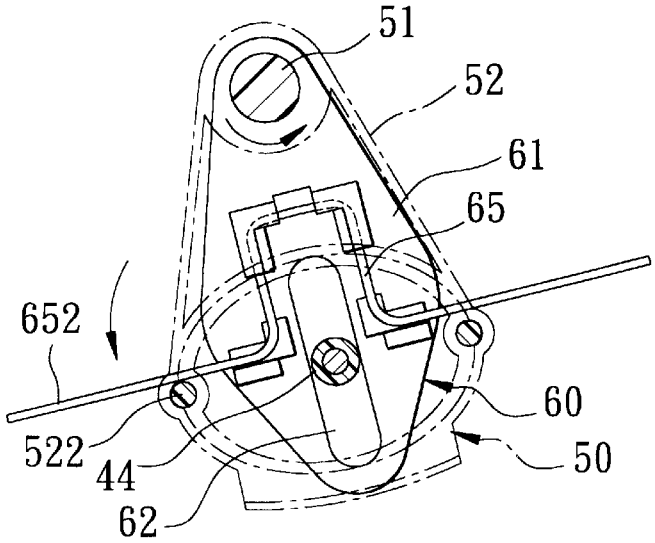
FIG. 8 illustrates synchronous swinging movement of the swingable member and the driving element to the rightward position.
Figure 9:
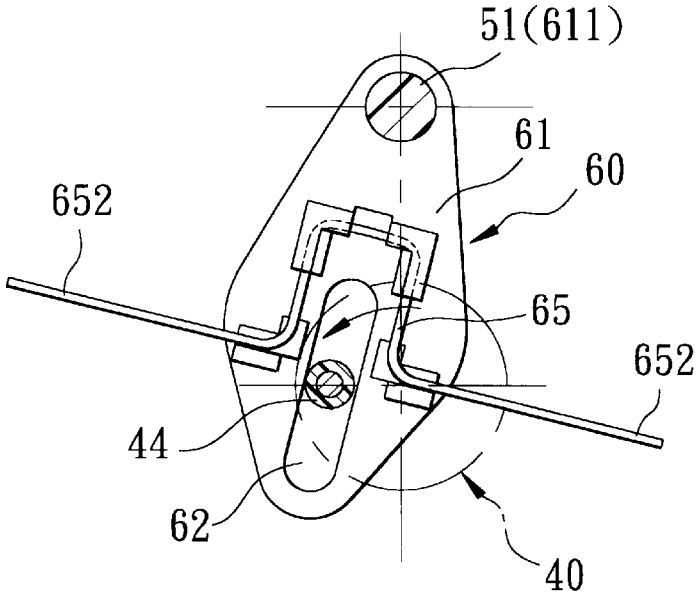
FIG. 9 illustrates how the driving element is moved to a leftward position due to the eccentric rotation of the pushing rod.
Figure 10:
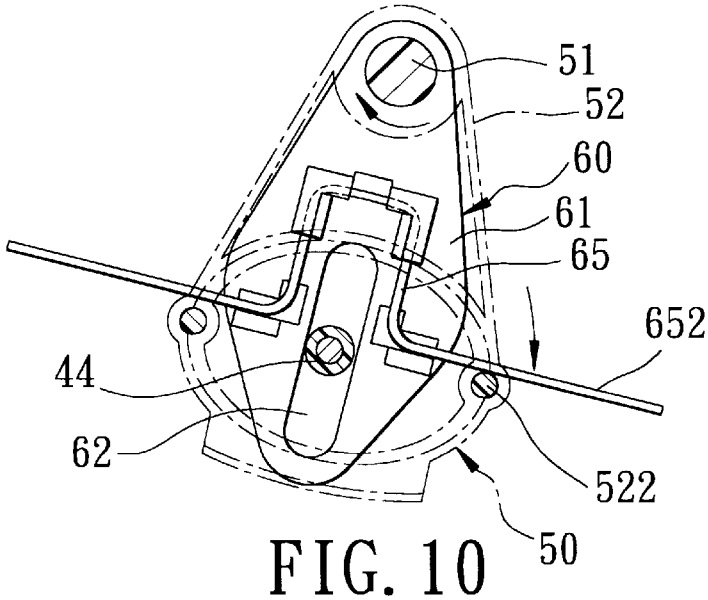
FIG. 10 illustrates synchronous swinging movement of the swingable member and the driving element to the leftward position.

Each of the driving units 60 further includes a motor 31 that is electrically connected to the batteries (not shown) and that is secured in a motor-mounting seat 25 via a motor-mounting bracket 32 and two fastener screws 321, a worm gear 40 that is mounted rotatably on a mounting shaft 26 disposed in the mounting space 202, that meshes with an output worm shaft 311 of the motor 31, and that has a side face 41, a tubular seat 43 formed eccentrically on the side face 41 of the worm gear 40, and a pushing rod 44 mounted on the tubular seat 43 of the worm gear 40 via a fastener screw 45. After assembly, the pushing rod 44 projects outwardly from the side face 41 of the worm gear 40 into the rod-receiving slot 62 in the mounting plate 612, and slidably contacts a periphery of the rod-receiving slot 62 (see FIG. 5) in such a manner that rotation of the motor 31 results in eccentric rotation of the pushing rod 44 (see FIGS. 7 and 9), which, in turn, results in pushing action on the periphery of the rod-receiving slot 62, thereby permitting swinging action of the swingable member 50 and the driving element 61 to leftward and rightward positions, as best shown in FIGS. 8 and 10.

Since the swingable member 50 is driven by the driving element 61 upon actuation of the motor 31, the aforesaid twisting of the urging member as encountered in the prior art swing device is thus eliminated.

Note that during assembly of the swing device of the present invention, the U-shaped rod portion 651 and the pushing arms 652 of the pushing part 65 can be easily and firmly mounted in the upper retention seat 63 and the lower retention seat 64 of the mounting plate 612, respectively. Swinging action of the swingable member 50 is relatively stable due to constant contact between the pushing arms 652 and the abutting studs 522. Moreover, the pushing arms 652 of the pushing part 65 can be easily constructed by mere bending of an elongated substantially stiff rod.

While the present invention has been described in connection with what is considered the most practical and preferred embodiments, it is understood that the present invention is not limited to the disclosed embodiments but is intended to cover various arrangements included within the spirit and scope of the broadest interpretation so as to encompass all such modifications and equivalent arrangements.

I claim:

1. A swing device comprising:

a supporting frame;

a seat unit having a seat member and a pair of opposing swing arms that are connected to said seat member and that are pivoted to said supporting frame so as to permit swinging of said seat member relative to said supporting frame; and a driving unit mounted on said supporting frame, and including a housing secured to said supporting frame, an axle defining a rotating axis, disposed rotatably in and extending out of said housing, and coaxially secured to one of said swing arms, and a swingable member disposed in said housing, coaxially secured to said axle, and swingable relative to said rotating axis so as to permit synchronous swinging of said seat unit through said axle, said swingable member having two opposing side portions and a pair of opposing abutting studs projecting respectively from said opposing side portions in an axial direction relative to said axle, said driving unit further including a driving element that is disposed in said housing, that is mounted rotatably on said axle, and that has a pushing part with two pushing arms extending oppositely in a first transverse direction relative to said axle and disposed above and in sliding contact with said abutting studs of said swingable member in such a manner that swinging of said driving element about said rotating axis results in alternate pushing of said abutting studs by said pushing arms, which, in turn, results in a synchronous swinging movement of said swingable member and rotation of said axle about said rotating axis, thereby permitting swinging of said swing arms.

2. The swing device as defined in claim 1, wherein said driving element further includes a tubular sleeve sleeved rotatably on said axle, and a mounting plate extending downwardly from said tubular sleeve and having two opposing side portions and an elongated rod-receiving slot disposed between said opposing side portions of said mounting plate and extending in a second transverse direction relative to said first transverse direction and said axle, said pushing part further having an inverted U-shaped rod portion mounted securely on said mounting plate between said side portions of said mounting plate, said pushing arms projecting oppositely said inverted U-shaped rod portion in said first transverse direction, said driving unit further including a motor secured in said housing and having an output worm shaft, a worm gear meshed with said worm shaft and having two opposite side faces, and a pushing rod mounted eccentrically on one of said opposite side faces said worm gear, projecting outwardly therefrom into said rod-receiving slot in said mounting plate, and slidably contacting a periphery of said rod-receiving slot in such a manner that rotation of said motor results in eccentric rotation of said pushing rod, which, in turn, results in pushing action on said periphery of said rod-receiving slot, thereby permitting swinging action of said driving element.

* * * * *